US005613397A

United States Patent [19]

Johansson

[11] Patent Number: 5,613,397

[45] Date of Patent: Mar. 25, 1997

[54] DEVICE FOR FIXING A VEHICLE TO A STRAIGHTENING BENCH

[75] Inventor: Uno Johansson, Linköping, Sweden

[73] Assignee: Uno Liner System Aktiebolag, Linkoping, Sweden

[21] Appl. No.: 392,867

[22] PCT Filed: Sep. 7, 1993

[86] PCT No.: PCT/SE93/00729

§ 371 Date: Mar. 1, 1995

§ 102(e) Date: Mar. 1, 1995

[87] PCT Pub. No.: WO94/05440

PCT Pub. Date: Mar. 17, 1994

[30] Foreign Application Priority Data

Sep. 8, 1992 [SE] Sweden ..... 920590

[51] Int. Cl.[6] ..... B21D 1/12

[52] U.S. Cl. ..... 72/422; 72/705; 248/229.11

[58] Field of Search ..... 72/422, 705; 248/229.1, 248/229.11, 229.12, 229.13, 229.14, 229.21, 229.23

[56] References Cited

U.S. PATENT DOCUMENTS 5,035,135 7/1991 Makela .
5,040,402 8/1991 Vierto .

FOREIGN PATENT DOCUMENTS 426660 2/1983 Sweden .
WO89/11354 11/1989 WIPO .

*Primary Examiner*—Lowell A. Larson
*Attorney, Agent, or Firm*—Quarles & Brady

[57] ABSTRACT

The invention relates to a device (1) for the fixing of a vehicle to an automobile body straightening bench. A car body rim (5) is fixed to a beam that extends from the automobile body straightener by means of two clamp jaws (3, 4) at each point of fixation. The clamp jaws (3, 4) are at their respective outer ends linked by a pair of scissor arms (3*a*, 3*b*; 4*a*, 4*b*). These are pivotally connected at two opposed connection points (6*a*, 6*b*). The two scissor arms (3*a*, 3*b*) for one of the clamp jaws (3) are linked by a first yoke (7), which is rotatably mounted in the scissor arms (3*a*, 3*b*). In the middle of the first yoke (7) there is a boring (7*a*) in which at least one threaded bolt (8) is driven. The scissor arms (4*a*, 4*b*) are linked by a plate (9) that is arranged to form a holding-up tool against the upper side (2*a*) of said beam (2). The scissor arms (4*a*, 4*b*) are pivotally connected to two mutually parallel slewing brackets (10*a*, 10*b*) by means of a shaft (11), whereby the other ends of the slewing brackets (10*a*, 10*b*) rotatably support a second yoke (12). This is provided with a tapped, drilled hole (12*a*) for the screw (8). Torsion springs operate between the scissor arms (4*a*, 4*b*) and the slewing brackets (10*a*, 10*b*). The slewing brackets (10*a*, 10*b*) are in connection with said shaft (11) provided with excentric surfaces (10*a*1, 10*b*1), which when the screws gradually are tightened are arranged to provide friction against the lower side (2*b*) of said beam (2).

2 Claims, 2 Drawing Sheets

DEVICE FOR FIXING A VEHICLE TO A STRAIGHTENING BENCH

The present invention relates to a device for fixing a vehicle to an automobile body straightening bench, at which a car body rim by means of two clamp jaws at each point of fixation is fixed to a beam that horizontally and essentially perpendiculary extends from the automobile body straightener.

At prior art devices of said type, e.g. in accordance with WO, A, 8911354, the fixation of the vehicle body at each point of fixation is performed by means of a screw fastening and one single tightening action at each point of fixation. The clamp jaws are fixed to the rim at the same time as the fastening devices are locked to the beam.

To attain the desired result at the straightening, it is important that the clamps jaws first are fixed to the car body rim and thereafter to the beam. However, at the prior art devices the fixation of clamp jaws to the car body rim is performed at the same time as the fastening device is clamped to the beam, which might cause undesired stretching strain.

The aim of the present invention is to provide a device of said type by means of which the fixing of the vehicle body at each point of fixation is accomplished so that the clamp jaws by means of a single tightening action first of all are fixed to the car body rim and thereafter to the beam. This is attained in that said clamp jaws at their respective outer ends are linked by a pair of scissor arms, which are pivotally connected at two opposed connection points, whose imagined junction line is parallel to the longitudinal directions of the clamp; in that the pair of scissor arms for one clamp jaw are linked by a yoke, which is parallel to the junction line and in the middle of which there is a boring that is perpendicular to the yoke, in which boring at least one threaded bolt is driven; in that the scissor arms for the other clamp jaws are linked by a plate that is arranged to form a holding-up tool against the upper side of said beam and according to the characterizing portion of the invention in that said first yoke is pivotally mounted in the scissor arms for one clamp jaw; in that the ends of the scissor arms for the other clamp jaw are pivotally connected to two mutually parallel slewing brackets by means of a shaft that is parallel to the junction line, whereby the other ends of the slewing bracket rotatably support a second yoke, which is parallel to the junction line and which is provided with a tapped, drilled hole, in which said screw is arranged to be fitted; in that torsion springs operate between the scissor arms of the second clamp jaw and the slewing brackets and in that the slewing brackets in connection with said shaft are formed with excentric surfaces, which are arranged to provide friction against the lower side of said beam when the screws gradually are tightened.

Figure 1:
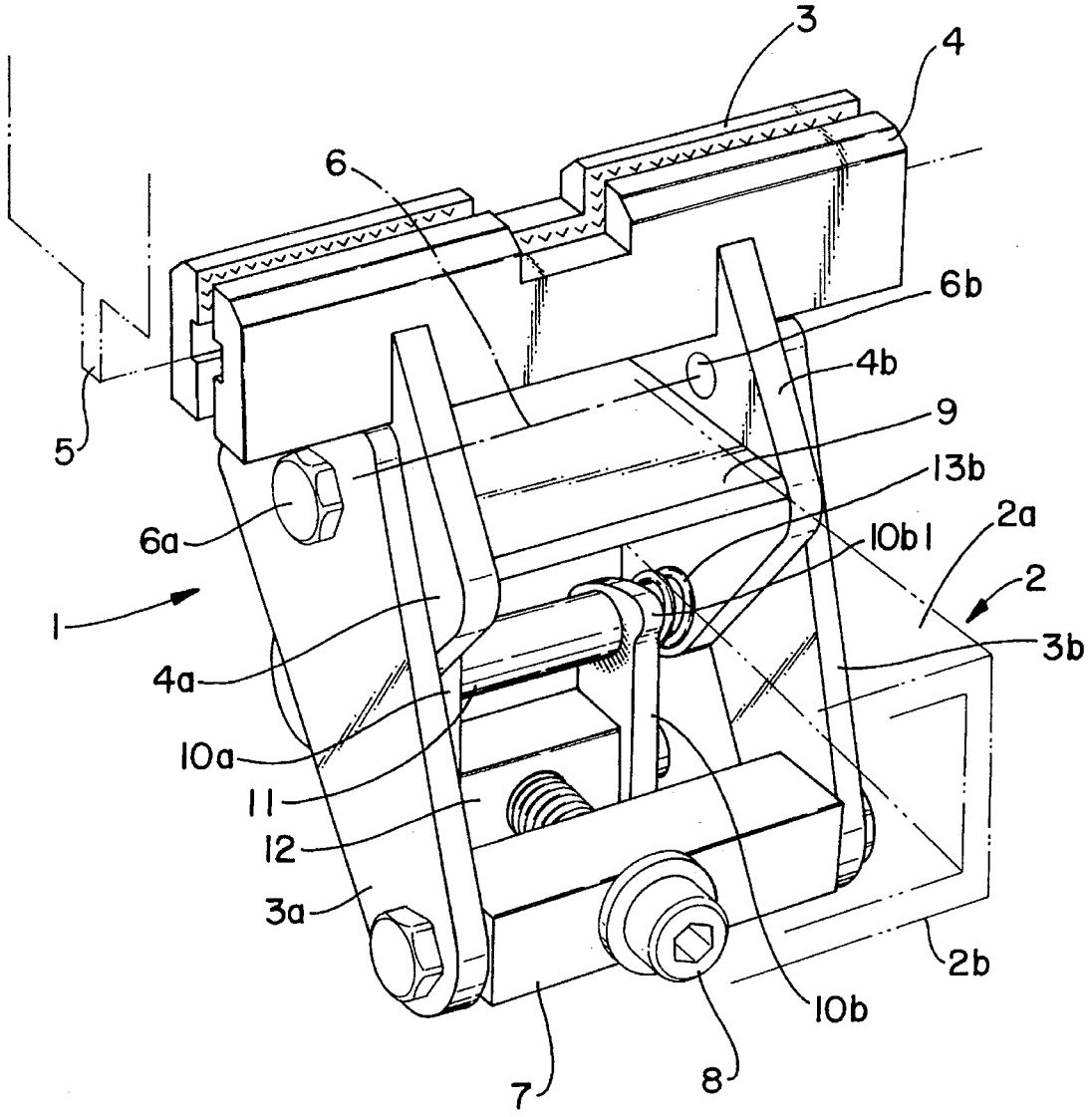
Figure 2:
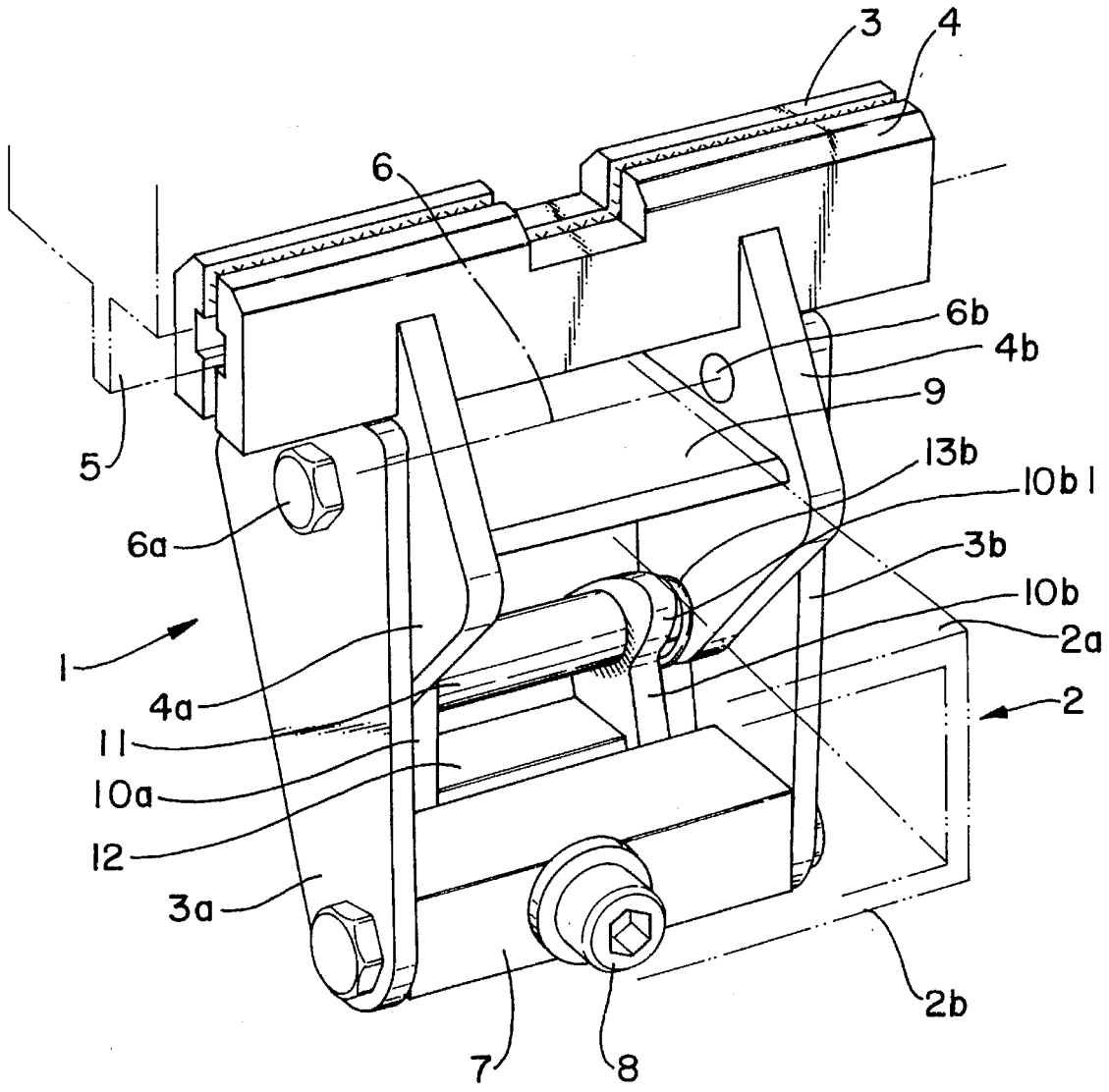

In the following, the invention will be explained with reference to the attached drawing, which schematically in a perspective illustrates how a car body rim is fixed by means of a device according to the invention, whereby FIG. 1 displays how the clamp locks a car body rim while maintaining its movability along the beam and FIG. 2 shows how the device according to the invention is locked in relation to the beam.

In the drawing, 1 generally indicates an embodiment of a device according to the invention, of which four are used in a conventional car body straightening bench (not shown). The device is mounted from a beam 2, which extends perpendiculary and horisontally from the straightening bench.

The device 1 includes two clamp jaws 3, 4 which are intended to clamp a rim 5, which conventionally is placed near the door sill of the vehicle and functions as a reference for straigtening of a vehicle that has been deformed in a traffic accident or the like, as is well known to the person skilled in the art.

Near their respective outer ends the clamp jaws 3, 4 are connected by a pair of scissor arms 3*a*, 3*b*, and 4*a*, 4*b* respectively, which are pivotally connected at two connection points 6*a*, 6*b*, e.g. by means of screws through the scissor arms. An imagined junction line 6, between the connection points 6*a*, 6*b* is parallel to the longitudinal direction of the clamp jaws 3*a*, 3*b*; 4*a*, 4*b*. At the end of the scissor arms 3*a*, 3*b* that is opposite to the clamp jaw 3, the scissor arms 3*a*, 3*b* are linked by a pivotally mounted yoke, which is parallel to the line 6 and preferably has a squared cross-section. A screw is positioned in a drilled hole 7*a* (not appearing in the drawing) in the middle of the yoke. The scissor arms 4*a*, 4*b* of the other clamp jaw 4 are linked by a plate 9, that is arranged to form a holding-up tool against the upper side 2*a* of the beam 2. The scissor arms 4*a*, 4*b* are rotatably connected to two mutually parallel slewing brackets 10*a*, 10*b*. The rotatable connection between the scissor arms 4*a*, 4*b* and the slewing brackets 10*a*, 10*b* is obtained by means of a shaft 11, which is parallel to the junction line 6. At their other ends the slewing arms 10*a*, 10*b* pivotally upholds a second yoke 12, preferably with squared cross-section. The yoke 12 is parallel to the junction line 6 and is provided with a tapped, drilled hole 12*a* (not appearing in the drawing), in which the screw 8 is introduced.

Torsions springs 13*a*, 13*b* operate between the scissor arms 4*a*, 4*b* and the slewing brackets (only spring 13*b* appears on the drawing) in a way that will be described in the following. The ends of the slewing brackets 10*a*, 10*b* are provided with surfaces 10*a*1, 10*b*1 which are excentric relative to the shaft 11 and of which only one surface 10*b*1 appears in the drawing. These excentrical surfaces are arranged to provide friction against the lower side of said beam when the screw 8 is tightened.

The fixation device 1 according to the invention functions as follows:

With the vehicle to be straightened in a raised position, the device 1 is moved on the beam 2 to such a position that the rim 5 will be placed between the clamp jaws 3, 4 when the vehicle is lowered. It is of course necessary to establish that the opening between the clamp jaws 3, 4 is sufficiently wide for the rim 5 prior to the lowering of the vehicle. The screw 8 is now turned in a clock-wise direction by means of a ratchet wrench or the like, the influence of the torsion springs 13*a*, 13*b*, as is appearant in FIG. 1, will force the clamps 3, 4 to gradually clamp the rim 5 without forcing the excentric surfaces 10*a*1, 10*b*1 of the slewing brackets 10*a*, 10*b* to press against the lower side 2*b* of the beam 2. At this stage the fixation device 1 has the possibility to automatically position itself along the longitudinal direction of the beam as well as turn in relation to this direction in dependence of the position of the rim 5. This is essential for attaining a good result from the straightening. When the screw 8 is tightened further, the excentric surfaces 10*a*1, 10*b*1 will act against the surface 2*b*, as is apparent in FIG. 2 and which is noticable through the need for an increased tightening moment and the locking of the fixation device relative to the beam 2. The vehicle is now clamped in the car body straightener and the straightening procedures can be performed.

After the straightening has been conducted, the vehicle is released by loosening the screw 8.

I claim:

1. A device for the securing of a vehicle in an automobile body straightening bench, in which a car body rim (5) is fixed to a beam, said device comprising:

two clamp jaws (3,4), a pair of scissor arms connected to each of said clamp jaws, said pairs of scissor arms being pivotally connected at two opposed points (6*a*, 6*b*), said opposed points having an imagined junction line (6) parallel to the longitudinal axes of the clamp jaws (3,4), a yoke linking the pair of scissor arms (3*a*, 3*b*) for one clamp jaw (3), said yoke being parallel to the junction line and having a boring (7*a*);

at least one threaded bolt (8) extending through said boring;

a plate (9) linking the scissor arms (4*a*, 4*b*) for the other clamp jaw (4), whereby said plate (9) is arranged to form a holding-up tool against an upper side (2*a*) of the beam (2);

two mutually parallel slewing brackets (10*a*, 10*b*) pivotally connected to the scissor arms (4*a*, 4*b*) for the other clamp jaw (4);

a shaft (11) parallel to the junction line (6) connecting the slewing brackets (10*a*, 10*b*) to the scissor arms for the other clamp jaw (4);

a second yoke rotatably supported by said slewing brackets (10*a*, 10*b*), said second yoke being parallel to the junction line (6) and provided with a tapped, drilled hole (12*a*), through which said threaded bolt (8) extends;

torsion springs disposed between the scissor arms (4*a*, 4*b*) of the second clamp jaw (4) and the slewing brackets (10*a*, 10*b*);

wherein the slewing brackets (10*a*, 10*b*) are formed with eccentric surfaces (10*a*1, 10*b*1), whereby the slewing brackets are arranged to provide friction against the lower side (2*b*) of said beam (2) when the bolt is tightened to close the clamping jaws.

2. A device for the securing of a vehicle in an automobile body straightening bench, in which a car body rim (5) is fixed to a beam, said device comprising:

two clamp jaws (3,4), a pair of scissor arms connected to each of said clamp jaws, said pairs of scissor arms being pivotally connected at two opposed points (6*a*, 6*b*), said opposed points having an imagined junction line (6) parallel to the longitudinal axes of the clamp jaws (3,4), a first yoke linking the pair of scissor arms (3*a*, 3*b*) for one clamp jaw (3), said yoke being parallel to the junction line and having a boring (7*a*);

at least one threaded bolt (8) extending through said boring;

a plate (9) linking the scissor arms (4*a*, 4*b*) for the other clamp jaw (4), whereby said plate (9) is arranged to form a holding-up tool against an upper side (2*a*) of the beam (2);

two mutually parallel slewing brackets (10*a*, 10*b*) pivotally connected to the scissor arms (4*a*, 4*b*) for the other clamp jaw (4);

a second yoke rotatably supported by said slewing brackets (10*a*, 10*b*), said second yoke being parallel to the junction line and provided with a hole (12*a*), through which said threaded bolt (8) extends for urging the first yoke and the second yoke together and apart;

torsion springs disposed between the scissor arms (4*a*, 4*b*) of the second clamp jaw (4) and the slewing brackets (10*a*, 10*b*);

wherein the slewing brackets (10*a*, 10*b*) are formed with eccentric surfaces (10*a*1, 10*b*1), whereby the slewing brackets are arranged to provide friction against the lower side (2*b*) of the beam (2) when the bolt is tightened to close the clamping jaws.

* * * * *